US008622519B2

(12) United States Patent
Watanabe

(10) Patent No.: US 8,622,519 B2
(45) Date of Patent: Jan. 7, 2014

(54) INKJET HEAD

(75) Inventor: Hideo Watanabe, Hachioji (JP)

(73) Assignee: Konica Minolta IJ Technologies, Inc., Tokyo (JP)

( * ) Notice: Subject to any disclaimer, the term of this patent is extended or adjusted under 35 U.S.C. 154(b) by 0 days.

(21) Appl. No.: 13/514,214

(22) PCT Filed: Dec. 1, 2010

(86) PCT No.: PCT/JP2010/071454

§ 371 (c)(1),
(2), (4) Date: Jun. 6, 2012

(87) PCT Pub. No.: WO2011/074412

PCT Pub. Date: Jun. 23, 2011

(65) Prior Publication Data

US 2012/0249680 A1 Oct. 4, 2012

(30) Foreign Application Priority Data

Dec. 18, 2009 (JP) ..... 2009-288262

(51) Int. Cl.
*B41J 2/135* (2006.01)

(52) U.S. Cl.
USPC ..... 347/44

(58) Field of Classification Search
USPC ..... 347/44
See application file for complete search history.

(56) References Cited

U.S. PATENT DOCUMENTS 5,646,661 A 7/1997 Asai et al.
5,959,643 A * 9/1999 Temple et al. ..... 347/40
6,338,545 B1 1/2002 Sekiya
6,353,279 B1 * 3/2002 Watanabe et al. ..... 310/359
6,736,492 B2 5/2004 Yamada et al.

(Continued)

FOREIGN PATENT DOCUMENTS

EP 0 653 303 A2 5/1995
JP 4-307254 A 10/1992

(Continued)

OTHER PUBLICATIONS

Extended European Search Report (EESR) dated Apr. 12, 2013 (in English) issued in counterpart European Application No. 10837441.4.

(Continued)

*Primary Examiner* — Matthew Luu
*Assistant Examiner* — Michael Konczal
(74) *Attorney, Agent, or Firm* — Holtz, Holtz, Goodman & Chick, PC

(57) ABSTRACT

An inkjet head with a harmonica-type head tip is configured in a way that wirings electrically connected to drive electrodes within channels are led rearward from a rear surface of the head tip. A groove is provided along an array direction of the channels in areas on the rear surface of the head tip in which the channels are not formed. A lead-out electrode, which is electrically connected to drive electrodes, is formed from the rear surface of the head tip to the interior of the groove. One end of a wiring member, which has connecting wirings upon an insulating material corresponding to the lead-out electrodes, is inserted into the groove. The drive electrode is electrically connected to the connecting wiring via the lead-out electrode as a result of the electrical connection of the connecting wiring within the groove to the lead-out electrode.

15 Claims, 6 Drawing Sheets

(56) References Cited

U.S. PATENT DOCUMENTS

| | | | |
|---|---|---|---|
| 2004/0130602 | A1 | 7/2004 | Watanabe |
| 2006/0213955 | A1 | 9/2006 | Watanabe |
| 2007/0070125 | A1 | 3/2007 | Watanabe |
| 2009/0193658 | A1 | 8/2009 | Watanabe |

FOREIGN PATENT DOCUMENTS

| | | | |
|---|---|---|---|
| JP | 9-94954 | A | 4/1997 |
| JP | 10-217456 | A | 8/1998 |
| JP | 29-61624 | B2 | 10/1999 |
| JP | 2000-211124 | A | 8/2000 |
| JP | 2002-178509 | A | 6/2002 |
| JP | 2002-210955 | A | 7/2002 |
| JP | 2004-358751 | A | 12/2004 |
| JP | 2005-66924 | A | 3/2005 |
| JP | 2006-035454 | A | 2/2006 |
| JP | 2007-83705 | A | 4/2007 |

OTHER PUBLICATIONS

International Search Report dated Dec. 2, 2010 issued in International Appln. No. PCT/JP2010/071454.

* cited by examiner

INKJET HEAD

This application is a U.S. National Phase Application under 35 USC 371 of International Application PCT/JP2010/071454 filed Dec. 1, 2010.

TECHNICAL FIELD

The present invention relates to an inkjet head and in particular to an inkjet head having an improved configuration to lead out electrodes from a harmonic type head chip.

PRIOR ART

In the past, there has been known an inkjet head having a share mode type head chip. The head chip is a so-called harmonica type head chip in which a plurality of channels are formed on a piezoelectric element substrate in parallel by grinding, drive electrodes are formed on driving walls to divide the channels and openings of the channels are disposed at rear and front surfaces, wherein the driving walls are subject to share deformation by applying voltage onto the drive electrodes to eject ink in the channels from nozzles disposed on a front surface. (Patent Document 1: Unexamined Japanese Patent Application Publication No. H10-217456, Patent Document 2: Unexamined Japanese Patent Application Publication No. 2006-35454)

The above harmonica type head chip, has a difficulty in electrical connection between each drive electrode and a drive circuit so as to apply a drive signal onto the drive electrode in each channel therefore various technologies have been elaborated in the past.

For example, in the Patent Document 1 as to a head chip having two channel rows, a lead-out electrode is led out to an upper surface and a lower surface of the head chip via a front surface of the head chip with respect to the drive electrode in each channel. On a rear surface of the head chip, an ink manifold configuring a common ink chamber to commonly supply ink to each channel in the two rows is jointed. Driver ICs are disposed on an upper surface and a lower surface of the manifold respectively. Respective lead-out electrodes on the upper surface and the lower surface of the head chip are electrically connected to the driver IC via wire bonding. The driver ICs are electrically connected with signal lines from outside by jointing a FPC.

Also, in Patent Document 2, each drive electrode is electrically connected with a wiring of the wiring substrate via the lead-out electrode by arraying the lead-out electrodes arrayed with respect to respective channels on the rear surface of the head chip and by jointing the wiring substrate, on which the wirings are formed to correspond with the lead-out electrodes, with the rear surface of the head chip so as to protrude in an array direction of the channel rows in the head chip. On the wiring substrate openings are formed to correspond with respective channels thus ink can be supplied to the inside of each channel from the manifold jointed on a rear surface side of the wiring substrate.

According to the structure of the inkjet head described in Patent Document 2, by forming the wiring substrate so as to protrude at each side in the array direction of the channel rows in the head chip, wiring corresponding to the lead-out electrode from channels in two rows at each side of the head chip can be led out, even in case the head chip has four rows of the channels at a maximum.

PRIOR ART

Patent Document

Patent Document 1: Unexamined Japanese Patent Application Publication No. H10-217456, Patent Document 2: Unexamined Japanese Patent Application Publication No. 2006-35454

DISCLOSURE OF THE INVENTION

Problems to be Solved by the Invention

Due to recent demands of density growth of the nozzles, further increase of the channel rows has been necessary for the inkjet head having such harmonic type head chip. Therefore, besides n inkjet head having four rows, an inkjet head having five rows or more than five rows have been further requested.

However, according to the technology described in Patent Document 1, since the lead-out electrodes let out from respective channels in two channel rows are formed to be separated respectively to the upper surface and the lower surface of the had chip, it is difficult to configure a head chip having three or more channel rows.

On the other hand, according to the technology described in Patent Document 2, it is possible to configured a head chip having four rows of channels though it is difficult to lead out the wirings corresponding to three or more than three rows of channels to the same direction of the head chip, and the technology can not be applied to a head chip having five or more than five rows of channels.

It is considered that the inkjet head having five or more than five channel rows can be configured by disposing a plurality of the head chips of Patent Documents 1 and 2. However, in this case, the wirings led outside the head chip from respective channels interfere each head chip to be arranged in parallel with narrow intervals. The inkjet head is required to be thin in a scanning direction, however since the head chips cannot be disposed densely, there was a problem that the head chip having multiple channels is difficult to be thinner.

Further, the harmonica type head chip has an advantage that a large number of the head chips in the same shape can be produced by separating a large size channel substrate in one piece in which channels are arrayed via full-cut. However, in case a plurality of the head chips of Patent Documents 1 and 2 are arrayed, after connecting wirings for each head chip having two to four channel rows, a plurality of the head chips having been connected with the wirings have to be arranged in parallel each other thus the head chips having five or more than five channel rows cannot be obtained via full-cut of the large size channel substrate at one time, whereby there is a problem of reducing productivity.

An object of the present invention is to provide an inkjet head superior in the productivity wherein in the inkjet head having the harmonica type head chip, the wirings electrically connected with the drive electrodes in respective channels as is can be led rearwards from the rear surface of the head chip and thickness can be reduced even if the head tip has a plurality of channels rows arranged in parallel.

Means to Solved the Problem

The above problem can be solved by the following

1. An inkjet head, having; a head chip, wherein drive walls configured with piezoelectric elements and channels are arranged in parallel alternately, an inlet and an outlet of each channel are provided on a front surface and a rear surface respectively and a drive electrode is fouled on a surface of each drive wall facing inside the channel, so as to eject ink in the channel from a nozzle disposed on the front surface of the head chip by deforming the drive wall by applying voltage onto the drive electrode, wherein a groove is formed along an array direction of the channel on an area of the rear surface of the head chip where the channel is not formed, a lead-out electrode electrically connected with the drive electrode is formed from the rear surface of the head chip to an inside of the groove, and by inserting an end of a wiring member, provided with a connection wiring corresponding to the lead-out electrode on an insulation member, into the groove, the connection wiring in the groove is electrically connected with the lead-out electrode so as to electrically connect the drive electrode with the connection wiring via the lead-out electrode.

2. The inkjet head of item 1, wherein, the wiring member contacts to a lead-out electrode side in the groove with pressure via a filling member provided at an opposite surface side to a connection wiring forming surface so as to electrically connect the connection wiring with the lead-out electrode.

3. The inkjet head of any one of item 2, wherein the filling member is a foamable resin material which foams and inflates by heat.

4. The inkjet head of any one of items 1 to 3, wherein the wiring member includes a solder electrode on the connection wiring disposed in the groove so as to electrically connect the connection wiring and the lead-out electrode by melting the solder electrode.

5. The inkjet head of any one items 1 to 4, wherein an ink manifold configuring a common ink chamber to commonly supply ink with respect to each channel is provided on the rear surface of the head chip and the wiring member protrudes from the groove via an inside of the common ink chamber so as to penetrate the ink manifold.

6. The inkjet head of items 1 to 5, wherein the head chip includes five or more than five channel rows.

Effect of the Invention

According to the present invention, in the inkjet head having the harmonica type head chip, the wirings electrically connected with the drive electrodes in respective channels is can be led rearwards as is from the rear surface of the head chip and the thickness of the head chip can be reduced even if the head chip has a plurality of channel rows arranged in parallel. Therefore the inkjet head having excellent productivity can be provided.

DESCRIPTION OF THE PREFERRED EMBODIMENTS

Figure 1:
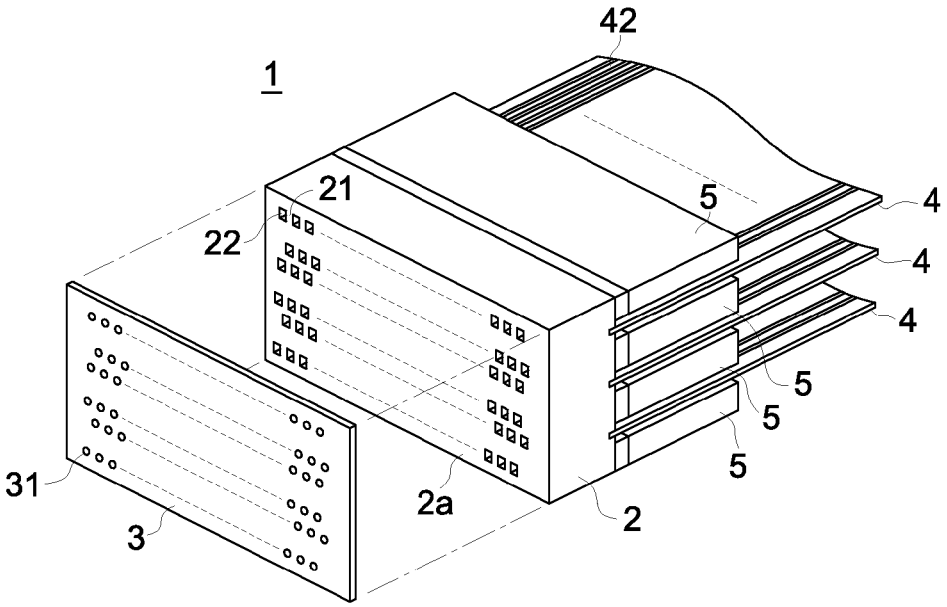
FIG. 1 is a perspective view of an embodiment of an inkjet head related to the present invention.

The inkjet head related to the present invention has a head chip wherein drive walls configured with piezoelectric elements and channels are arranged alternately in parallel, an outlet port and an inlet port are disposed on a front surface and a rear surface respectively for each channel and a drive electrode is formed on a wall surface of the drive wall facing inward in the channel. The above head chip is a so-called harmonica type head chip in a shape of a hexahedron, wherein by applying voltage onto the drive electrode, the drive wall deforms in a shape of dog leg to create pressure change in the ink supplied to the channel for ejection, so as to eject an ink droplet from the nozzle disposed on the front surface of the head chip.

In the present invention, as to such harmonica type head chip, a surface on which the nozzle is disposed so as to eject ink is defined as a "front surface and a surface on opposite side thereof is defined as a "rear surface". Also, opposing outside surfaces of the head chip sandwiching the channel rows are defined as an "upper surface" and a "lower surface" respectively.

In the present invention, in an area where the channels are not formed on the rear surface of the forgoing head chip, a grove is disposed along an array direction of the channels. The area where the channels are not formed on the rear surface of the head chip is to except an area where the inlet ports of the channels are arrayed. It is preferred that the groove is formed in an area adjacent to an area where the inlet ports of the channels are arrayed in parallel to the array direction of the channels.

A length of the groove is preferred to coincide with a width of the head chip along the array direction of the channels. A width of the groove is appropriately determined in accordance with a width of a forming area of the groove on the rear surface of the head chip and a thickness of a wiring member to be described. Also, a depth of the groove can be 200 to 800 μm.

The lead-out electrode is formed independently for each channel. An end of the lead-out electrode is electrically connected with the drive electrode disposed on the drive wall facing inward in the channel. The lead-out electrode is formed so that other end of the lead-out electrode reaches to an inside of the groove from each channel via the rear surface of the head chip adjacent to the inlet port of the aforesaid channel. Each lead-out electrode is formed independently for each channel so that short circuit does not occur even inside the groove.

One end of the wiring member is inserted in the groove. On the wiring member, connection wirings corresponding to respective lead-out electrodes are disposed in the same pitch as that of the lead-out electrode on the insulation material. By inserting the wiring member into the groove, the connection wiring on the wiring member and the lead-out electrode are electrically connected. Whereby, the drive electrode in each channel is electrically connected with the connection wiring on the wiring member via the lead-out electrode on the rear surface of the head chip. By inserting the one end of the wiring member into the groove provided on the rear surface of the head chip, the wiring member is disposed perpendicular to the rear surface of the head chip, thus other end of the wiring member as is protrudes to a rearward of the head chip.

Therefore, according to the present invention, the connection wiring to be electrically connected with the drive electrode in each channel can be led out rearward as is from the rear surface of the head chip, thus it does not protrude to the upper surface or the lower surface of the head chip. Also, since no electrodes are formed on the upper surface and the lower surface of the head chip, a thin head chip can be formed, even if a plurality of the channel rows are arranged in parallel.

It is remarkable that according to the present invention since even the head chips having five or more than five channel rows can be manufactured at one time via full-cut of a large size channel substrate provided with five or more than five channel rows, the inkjet head can possess excellent productivity.

Therefore, an effect of the present invention is remarkable particularly in the head chip having five or more than five channel rows.

In the present invention, while the groove can be disposed to correspond with the channel row one-on-one, in case of the head chip having the plurality of the channel rows, each other end of the lead-out electrode from each channel in the plurality of the channel rows can be led inside one groove. The grooves are disposed between the plurality of the channels and the each lead-out electrodes are formed so as to reach to the inside of each groove from both sides of each groove thereof. Therefore, on the wiring member inserted in the groove, the connection wirings are formed on both sides of the insulation material.

In the present invention, while the insulation material to form the wiring member is not particularly specified, a flexible material is preferred. For example, resin films such as polyimide, aramid, and polyethylene telephthalate are cited. An aramid film is particularly preferred since the aramid film has high strength which can be maintained even if the film is thin. A thickness of the insulation material of 3 to 100 μm is preferable.

The connection wiring on the wiring member and the lead-out electrode have to be electrically connected each other firmly in the groove. To enable electrical connection between the connection wiring and the lead-out electrode in the groove, while an adhesive can be used usually, in the groove, the connection wiring and the lead-out electrode can be electrically connected in a way that by providing a filling material on an opposite surface side to the connection wiring forming surface, the wiring member is pressed to contact with the lead-out electrode side by the filling material.

The above filling material is preferred to be a foam resin material which creates foam and inflates by heat. The foamable resin material is made by adding forming agent (forming capsule) which creates form by heating. After filling the foamable resin material on the opposite surface side to the connection wiring forming surface of the wiring member inserted in the groove, the foaming agent is heated to create foam and inflated, thus pressure contact force to contact the connection wiring with the lead-out electrode by pressure is exerted effectively and reliable electric connection is realized by contacting the connection wiring and the lead-out electrode firmly.

As an example of the foamable resin material, heat expandable micro capsule of Matsumoto Yushi-Seiyaku Co., Ltd. can be utilized. An average particle diameter of the micro capsule and a base polymer of the filling material can be selected in accordance with a width of the channel and a thickness of the wiring member without being restricted. For example, the average particle diameter can be selected in the range of 5 to 50 μm. A forming magnitude can be selected in the range of 2 to 10 times. As a base polymer an epoxy resin can be selected.

As another method, at the wiring member, a solder electrode can be provided on the connection wiring disposed in the groove. By inserting an end of such wiring member into the groove and by melting the solder electrode by heat firm electric connection between the connection wiring and the lead-out electrode can be realized.

On the rear surface of the head chip, an ink manifold forming a common ink chamber to supply ink commonly to each channel is disposed. In this configuration, the groove on the rear surface of the head chip can be disposed so as to avoid the ink manifold. Or by disposing the groove in an area facing the inside of the common ink chamber on the rear surface of the head chip, the wiring member can be disposed and extended from the groove so as to penetrate the ink manifold via the inside of the common ink chamber.

Next, an exemplary embodiment of an inkjet head related to the present invention will be described with reference to the drawings.

Figure 2:
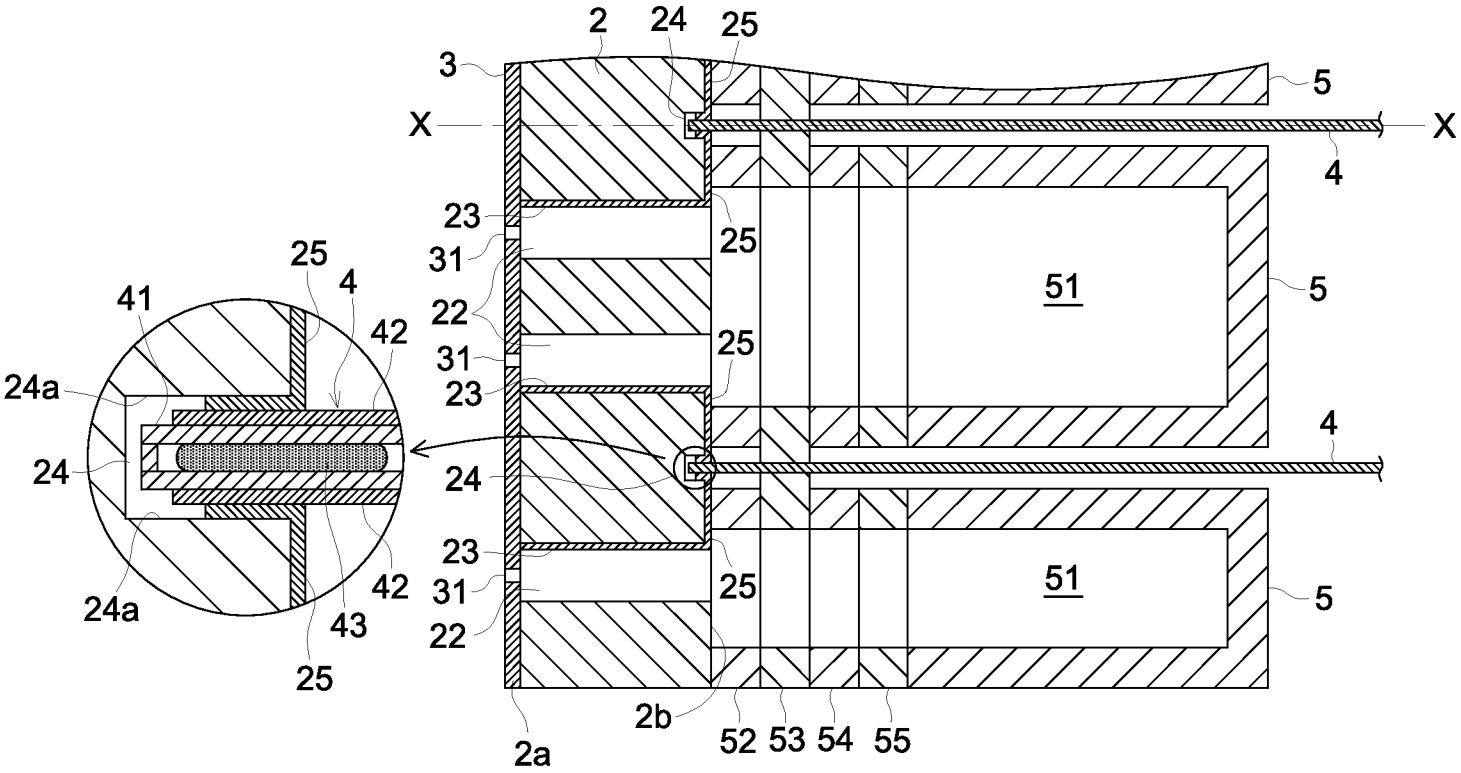
FIG. 2 is a partial cross-sectional view of an inkjet head shown in FIG. 1.
Figure 3:
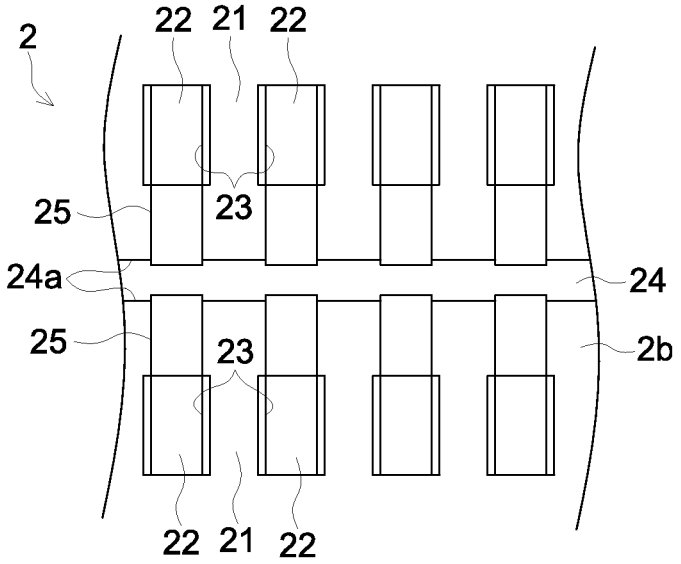
FIG. 3 is a view partially showing only a rear surface of a chip head shown in FIG. 1.

FIG. 1 is a perspective view showing an embodiment of an inkjet head, FIG. 2 is a partial cross-sectional view thereof and FIG. 3 is view partially showing only a rear surface of the head chip.

The inkjet head 1 of the embodiment includes a head chip 2, a nozzle plate 3, wiring members 4 and ink manifolds 5.

The head chip 2 is a harmonica type head chip in a shape of a hexahedron wherein drive walls 21 configured with the piezoelectric elements and channels 22 are arranged in parallel alternately, an outlet port of each channel opens at a front surface 2*a*, and an inlet port of each channel opens at a rear surface 2*b*. In the head chip 2 shown by the present embodiment, six channel rows configured by arranging a plurality of the drive walls 21 and a plurality of the channels 22 in parallel are arrayed one above the other in parallel. In the present embodiment, a dimension of the head chip 2 in the array direction of the channel rows i.e. a vertical direction of the head chip 2 in the figure is 10.0860 mm, a height of the channel 22 in a vertical direction in the figure is 310 μm, a width of the channel 22 is 70μ and a width of the drive wall 21 is 70 μm.

Incidentally, in FIG. 2 only three rows in a lower half of the channel rows arrayed in parallel in the vertical direction in the figure are shown. The inkjet head 1 is symmetric in the vertical direction with respect to a line x-x in the FIG. 2.

On each drive wall 21 facing inward in the channel 22, a drive electrode 23 is formed. Also, on the rear surface 2*b* of the head chip 2 a groove 24 is formed across the head chip 2 in the width direction in parallel to an array direction of each channel 22 in the channel rows. hi the present embodiment, within the six channel rows, every two channel rows from the end section configure one group, and the groove 24 is formed between the two channel rows in each group, whereby a total of three grooves 24 are provided. Here, the width of the groove 24 is 82 μm and the depth thereof is 300 μm.

The lead-out electrode 25 corresponding to each channel 22 one-to-one, is formed from the inside of each channel 22 to the groove 24 adjacent to the channel 22 thereof. Namely, one end of the lead-out electrode 25 is connected electrically with the drive electrode 23 in each channel 22, and another end is disposed on each side wall surface 24*a* facing each other in the groove 24 via a rear surface of the head chip 2 from the inside of each channel 22.

In the present invention, since the other end of the lead-out electrode 25 from each channel 22 disposed on both sides of the groove 24 is disposed in one groove 24, the other end of each lead-out electrode is arranged on the both side walls 24*a* of the groove 24 with the same pitch as the arraying pitch of each channel 22.

By inserting the one end of each wiring member 4 into the groove 24, each wiring member 4 protrudes to the rearward of the head chip 2 in a direction perpendicular to the rear surface 2*b* of the head chip 2. Therefore, the wirings do not protrude at other surfaces than the rear surface 2*b* of the head chip 2.

In the wiring member 4, on the surface of the substrate 41 configured with an insulation material, the connection wirings 42 are arrayed in the same pitch as that of the lead-out electrodes 25 arrayed in the groove 24. Here, in order to correspond with each lead-out electrode 25 arrayed on both side wall surfaces 24*a* of the groove 24, one substrate 41 is folded into two so that each outside surface thereof becomes a wiring member 4 on which connection wirings 42 are arrange. The end section on folding side is inserted into the groove 24. When inserting, positioning is carried out so that each lead-out electrode 25 and each connection wiring 42 corresponding thereto coincided each other.

In the groove 24, a foamable resin material 43 is filled between the folded substrate 41 of the wring member 4 folded into two. Whereby, by utilizing a bias force caused by expansion of the foamable resin member 43 by heating the foamable resin member, each substrate 41 is pushed in a receding direction each other and the each connection wiring 42 is in pressure contact with corresponding lead-out electrode 25. Whereby reliable electrical connection between each lead-out electrode 25 and each connection wring 42 is realized. The foaming resin material 43 contacts the connection wiring 42 to the lead-out electrode 25 with pressure using an inflation force by foaming, thus appropriate contact pressure is created and there is not dangerousness to damage the head chip 2. For a purpose to further ensuring the electrical connection, an anisotropically conductive adhesive can intervene between each lead-out electrode and each connection wiring 42.

Figure 4:
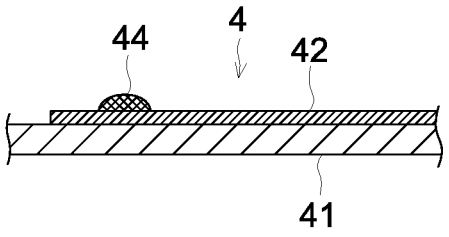
FIG. 4 is a partial cross-sectional view showing another embodiment of a wiring member.

In case the solder electrode is used to realize electrical connection, as FIG. 4 shows, a solder electrode 44 is formed on the end section of the connection wiring 42 disposed in the channel 24 in advance, then the wiring member 4 is positioned and inserted into the groove 24 thereafter, by heating and melting the solder electrode 44 electrical connection with the lead-out electrode 25 is realized. In the embodiment using the solder electrode 44, the foamable resin member is also filled on a surface on an opposite side to the forming surface of the connection electrode 42 in advance, then by foaming when heating the solder electrode 44 contacts to the lead-out electrode 25 with pressure. Thus, melted solder electrode 44 can connect with the lead-out electrode 25 more firmly.

In the present embodiment, one ink manifold 5 is disposed for each channel row positioned at both end sections of the head chip 2 and for four channels rows therebetween, one ink manifold 5 is disposed for every two channel rows adjacent each other. Thus a total of four ink manifolds 5 are jointed on the rear surface 2*b* of the head chip 2.

Inside each ink manifold 5, a common ink chamber 51 to commonly supply ink to corresponding channels 22 is formed. By supplying ink from an unillustrated ink supply port, ink is reserved. Ink of the same color can be supplied to each ink manifold 5 or ink of different colors can be supplied respectively to ink manifolds 5.

In the present embodiment, the groove 24 is provided on the rear surface 2*b* of the head chip 2 at each position between the four manifolds 5. Since the wiring member 4 is protruding from each groove 24 rearward, each wiring member 4 is disposed between these manifolds 5. Whereby, a connection portion between the lead-out electrode 25 and the connection wiring 42 does not contact with ink. Thus any kind of ink can be used.

A jointing section side of the manifold 5 with the head chip 2 is formed by laminating a plurality of substrates 52 to 55 having a thickness of 500 μm. One substrate 53 within the above substrates is disposed so as to sandwich each wiring member 4 at both sides thereof. Whereby, each wiring member 4 is supported by the substrate 53 at a vicinity of one end which is inserted into the groove 24 so as to maintain connection state with the groove 24.

Next, an exemplary method to manufacture the head chip 2 will be described with reference to FIGS. 5 to 8.

Figure 5A:
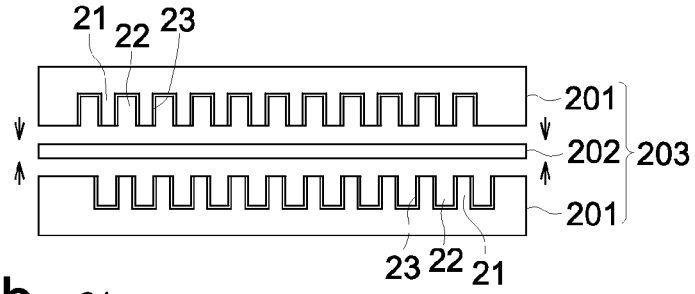
FIG. 5 is a diagram describing an exemplary manufacturing method of a head chip.
Figure 5B:
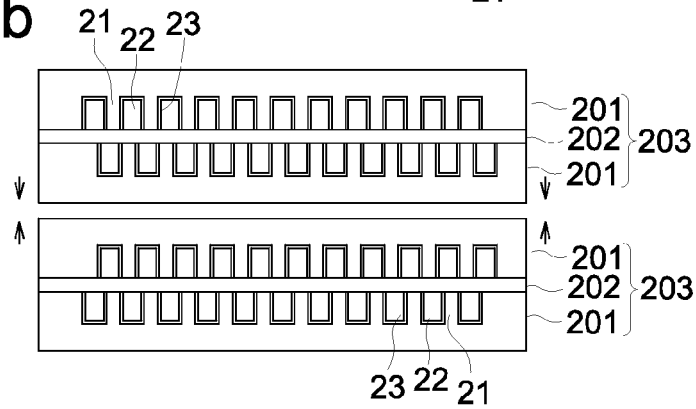

Two piezoelectric element substrates 201, wherein the drive walls 21 and the channels 22 are formed by grinding and the drive electrode 23 is formed in each channel 22, are laminated on one cover substrate 202 so that each channel 22 corresponds each other. Thus a channel substrate 203 having two channel rows is manufactured (FIG. 5*a*).

On the piezoelectric element substrate 201, each drive electrode 23 is formed on both side surfaces and a bottom surface in each channel 22.

Figure 5C:
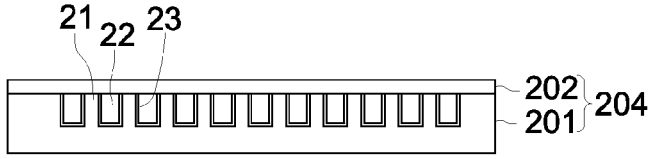
Figure 6:
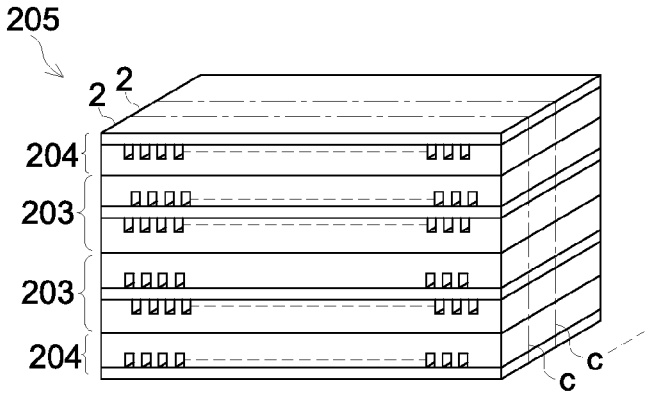
FIG. 6 is a diagram describing an exemplary manufacturing method of a head chip.

Next, two channel substrates 203 each having two channel rows are jointed to form a channel substrate 203, 203 having four channel rows (FIG. 5*b*), then on both sides of the channel substrates 203, 203, as FIG. 5*c* shows, two channel substrates 204 each formed by laminating a cover substrate 202 on one piezoelectric element substrate 201 having one channel row are jointed in a way that each piezoelectric element substrate 201 side contacts with the piezoelectric element substrate 201 of the channel substrate 203. Thus a large size channel substrate 205 having six channel rows is formed (FIG. 6).

Then by cutting the large size substrate 205 (full cut) along a plurality of cut lines c, c, . . . , in a direction perpendicular to a length direction of the channel 22, head chips 2, 2, . . . , each having six channel rows are manufactured at one time. The distances between the cut lines c, c, . . . , determine drive lengths of the channels 22 of the head chips 2.

Figure 7:
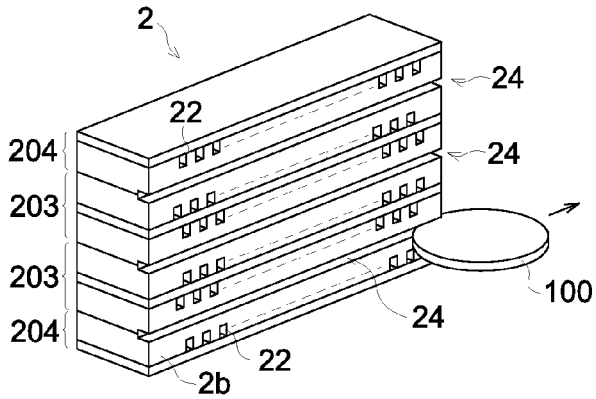
FIG. 7 is a diagram describing an exemplary manufacturing method of a head chip.

With respect to the rear surface 2*b* of the head chip 2 having six channel rows manufactured by the above method, using a dicing blade 10, the grooves 24 along the channel rows are grinded between the channel substrate 204 and the channel substrate 203 adjacent thereto as well as between the channel substrates 203 (FIG. 7).

Next, as FIGS. 8*a* to 8*d* show lead-out electrodes 25 are formed on the rear surface 2*b* of the head chip 2 on which the groove 24 is formed. In FIGS. 8*a* to 8*d*, left figures are magnified cross-sectional views of one groove 24 of the head chip 2, and right figures are that as viewed from a rear surface side.

Figure 8A:
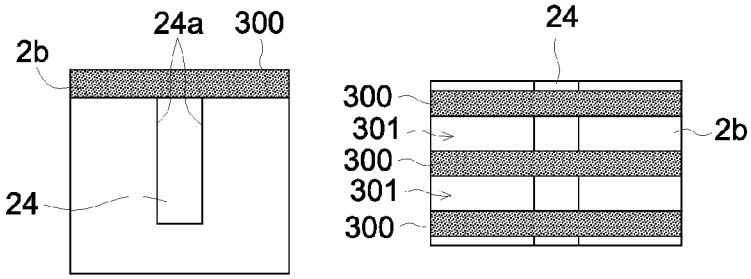
FIG. 8 is a diagram describing an exemplary manufacturing method of a head chip.

First, a dry film 300 is adhered on the entire rear surface 2*b* of the head chip 2 on which the grooves 24 are formed. Then by known exposing and developing processes, a forming area 301 of the lead-out electrode 25, from each channel 22 (not illustrated in FIG. 8) to the groove 24, are opened (FIG. 8*a*).

Figure 8B:
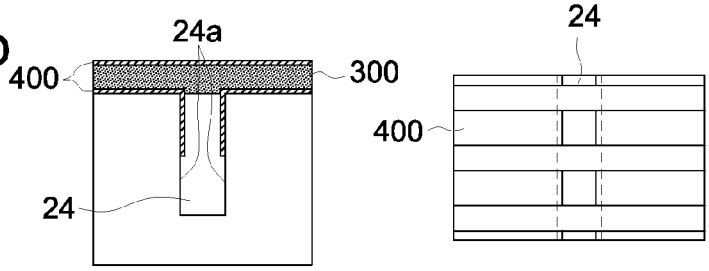

With respect to the rear surface 2*b* of the head chip 2, by evaporating an electrode forming material, a metal film 400 is formed (FIG. 8*b*).

Figure 8C:
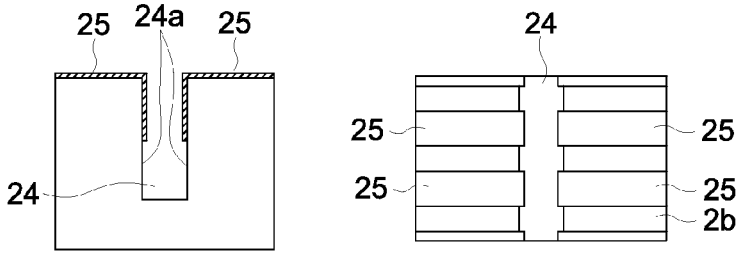

It is preferred that evaporation is carried out two time from different directions with respect to the rear surface 2*b* of the head chip 2 so as to ensure electrical connection with the drive electrode 23 in each channel and to ensure forming of the metal film 400 on both side wall surfaces 24*a* in the groove 24 as well. Specifically evaporating is carried out in directions 30° upward and downward along the array direction of the channel rows. As FIG. 8*c* shows the angle of evaporation, and the depth and width of the groove are selected so that the metal films 400 on both side wall surfaces 24*a* do not connect each other on the bottom section of the groove 24.

Also, instead of the evaporation method, a spattering method can be used. The spattering method is preferable, since flying directions of metal particles are random, the metal film 400 can be formed inside the channel 22 and inside the groove 24 without changing the direction. In case of the spattering method also, as FIG. 8*c* shows, the depth, the width and conditions of spattering are selected so that the metal films 400 on both side wall surfaces 24*a* do not connect each other on the bottom section of the groove 24.

After forming the metal film 400, by resolving and separating the dry film 300 with a solvent, the dry film 300 formed on the metal film 400 is removed. Therefore, on the rear surface 2*b* of the head chip 2, only the lead-out electrodes 25, from the inside of each channel 22 to the groove 24, are formed in an array independently for each channel 22 (FIG. 8*c*).

Figure 8D:
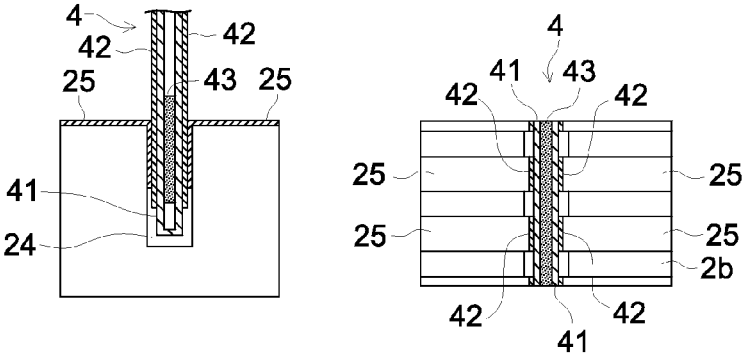

Next, one end of the wiring member 4, having the substrate 41 on which each connection wiring is formed, is positioned and inserted into the groove 24. Between the substrate 41,41 folded into two, the foamable resin material 43 is filled. By inflating the foamable resin material 43 with heat, the each connection wiring 42 contacts with the electrode 25 with pressure whereby, electric connection is realized (FIG. 8*d*).

Thereafter, a nozzle plate 3, on which nozzles 31 are formed at positions corresponding to the channels, is jointed on the front surface 2*a* of the head chip 2, and on the rear surface 2*b*, the ink manifold 5 is jointed, thus the inkjet head 1 is completed (refer to FIG. 1).

Figure 9:
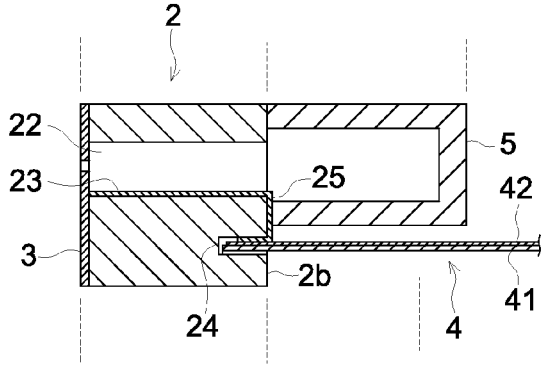
FIG. 9 is a cross-sectional view showing another embodiment of a head chip.

While the embodiments described in the foregoing are examples of the head chip 2 provided with three grooves 24 with respect to six channel rows, as FIG. 9 shows, in the head chip 2, the grooves 24 can be disposed to correspond with the channel rows one-to-one. Naturally, such head chip 2 can be one having one channel row or tow channel rows or more than two channel rows. Even in case of a head chip 2 having two or more than two channel rows, there can be obtain the same effect that the wiring member 4 can be disposed to protrude as is rearward from the rear surface 2*b* of the head chip 2, thus the head chip can be thinner and can be manufactured by full cutting of the large size channel substrate at one time.

Also, in the embodiments described in the foregoing, one groove 24 is disposed between two channel rows. Namely, inside the one groove 24, there is disposed the other end of the led-out electrode 25 led out from the inside of each channel 22 in one channel row on one side of the groove 24. However, in the present invention, in the one groove 24, there can be disposed the other end of the lead-out electrode 25 led out from the inside of each channel 22 in two or more than two channel rows disposed on one side of the groove 24.

Figure 10:
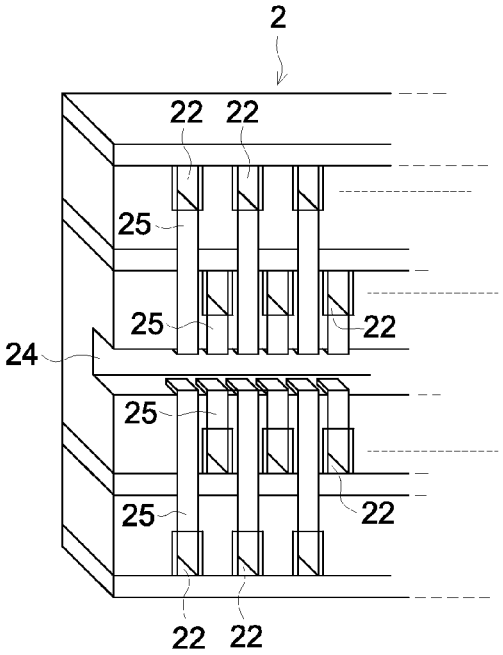
FIG. 10 is a cross-sectional view showing yet another embodiment of a head chip.

FIG. 10 shows an example of the head chip 2, wherein two channel rows are disposed respectively on both sides of one groove 24 and the other end of the lead-out electrode 25 led out from each channel 22 in the four channel rows in total is disposed. The channels 22 in the two channel rows on one side of the groove 24 are disposed so as to be displaced by ½ pitch each other. The lead-out electrode 25 led out from inside of each channel 22 in an outside channel row is formed to reach to the inside of the groove 24, via a gap between each channel 22 in an inside channel row and further via a gap between the lead-out electrodes 25 led out from the inside of each channel 22 in the inside channel row.

Whereby, since the number of the grooves with respect to the number of the channels can be reduced, man-hour of groove forming work and connection work of the wiring member can be reduced.

The number of the channel rows which allows the lead out electrodes to be disposed inside one groove can be five or more than five without being limited to four rows, as far as the lead-out electrodes and the connection wirings can be disposed without having dangerousness of occurrence of short circuit.

Figure 11:
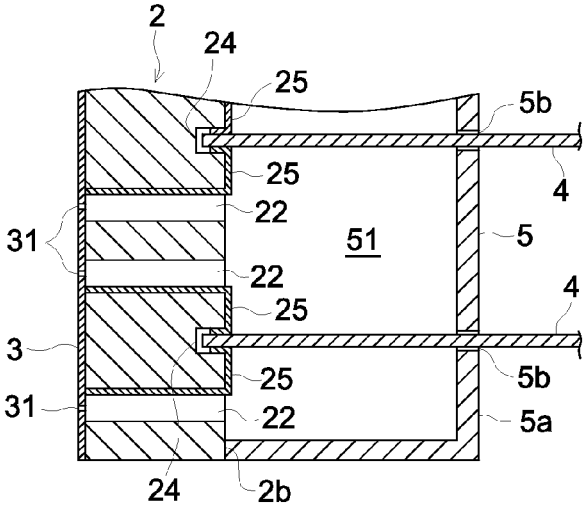
FIG. 11 is a cross-sectional view showing another embodiment of an ink manifold.

FIG. 11 shows an embodiment having other installation mode of the manifold 5.

In the embodiment, the ink manifold 5 is disposed so that the grooves 24 formed on the rear surface 2*b* on the head chip 2 face inside the common ink chamber 51. Namely, the wring members 4 inserted into the grooves 24 is protruding from the rear surface 2*b* of the head chip 2 to penetrate a rear section wall surface 5*a* of the ink manifold 5 through the inside of the common ink chamber 51. On the rear section wall surface 5*a* of the ink manifold 5, through sections 5*b* in the shape of a slit which enable the wiring member 4 to penetrate are formed where sealing members fix the wiring members 4 in a liquid-tight state.

Whereby, the wiring member 4 can be supported by the rear section wall surface 5*a* of the ink manifold 5. Also, even the head chip 2 having a plurality of the channel rows, manifold 5 can be disposed irrespective of installation positions and the number of the grooves 24.

DESCRIPTION OF THE SYMBOLS

1 Inkjet head
2 Head chip
2*a* Front surface
2*b* Rear surface
21 Drive wall
22 Channel
23 Drive electrode
24 Groove
24*a* Side wall surface of groove
25 Lead-out electrode
3 Nozzle plate
31 Nozzle
4 Wiring member
41 Substrate
42 Connection Wiring
43 Foamable resin material
44 Solder electrode
5 Ink manifold
5*a* Rear section wall surface
5*b* Through section
51 Common ink chamber
52 to 55 Substrate

What is claimed is:

1. An inkjet head, comprising:

a head chip, wherein drive walls configured with piezoelectric elements and channels are arranged in parallel alternately, an outlet port and an inlet port of each channel are provided on a front surface and a rear surface of the head chip, respectively, and a drive electrode is formed on a surface of each drive wall inside the channel, so as to eject ink in the channel from a nozzle disposed on the front surface of the head chip by deforming the drive wall by applying voltage to the drive electrode, wherein a groove is formed along an array direction of the channel on an area of the rear surface of the head chip where the channel is not formed, a lead-out electrode electrically connected with the drive electrode is formed from the rear surface of the head chip to an inside of the groove, and by inserting an end of a wiring member, provided with a connection wiring corresponding to the lead-out electrode on an insulation member, into the groove, the connection wiring in the groove is electrically connected with the lead-out electrode so as to electrically connect the drive electrode with the connection wiring via the lead-out electrode, and wherein the wiring member contacts a lead-out electrode side in the groove with contact pressure via a filling member provided at an opposite surface side to a connection wiring forming surface of the wiring member so as to electrically connect the connection wiring with the lead-out electrode.

2. The inkjet head of claim 1, wherein the filling member is a foamable resin material which foams and inflates by heat.

3. The inkjet head of claim 1, wherein the wiring member includes a solder electrode on the connection wiring disposed in the groove so as to electrically connect the connection wiring and the lead-out electrode by melting the solder electrode.

4. The inkjet head of claim 1, wherein an ink manifold configuring a common ink chamber to commonly supply ink with respect to each channel is provided on the rear surface of the head chip, and the wiring member protrudes from the groove via an inside of the common ink chamber so as to penetrate the ink manifold.

5. The inkjet head of claim 1, wherein the head chip includes at least five channel rows.

6. The inkjet head of claim 2, wherein the wiring member includes a solder electrode on the connection wiring disposed in the groove so as to electrically connect the connection wiring and the lead-out electrode by melting the solder electrode.

7. The inkjet head of claim 2, wherein an ink manifold configuring a common ink chamber to commonly supply ink with respect to each channel is provided on the rear surface of the head chip, and the wiring member protrudes from the groove via an inside of the common ink chamber so as to penetrate the ink manifold.

8. The inkjet head of claim 3, wherein an ink manifold configuring a common ink chamber to commonly supply ink with respect to each channel is provided on the rear surface of the head chip, and the wiring member protrudes from the groove via an inside of the common ink chamber so as to penetrate the ink manifold.

9. The inkjet head of claim 6, wherein an ink manifold configuring a common ink chamber to commonly supply ink with respect to each channel is provided on the rear surface of the head chip, and the wiring member protrudes from the groove via an inside of the common ink chamber so as to penetrate the ink manifold.

10. The inkjet head of claim 2, wherein the head chip includes at least five channel rows.

11. The inkjet head of claim 3, wherein the head chip includes at least five channel rows.

12. The inkjet head of claim 4, wherein the head chip includes at least five channel rows.

13. The inkjet head of claim 6, wherein the head chip includes at least five channel rows.

14. The inkjet head of claim 7, wherein the head chip includes at least five channel rows.

15. The inkjet head of claim 8, wherein the head chip includes at least five channel rows.

* * * * *